US005485794A

United States Patent [19]

Sing

[11] Patent Number: 5,485,794

[45] Date of Patent: Jan. 23, 1996

[54] STRUCTURE FOR PALLETS, FLOORING, PANELLING AND FENCING

[76] Inventor: Peter Sing, P.O. Box 11532, Winslow, Wash. 98110

[21] Appl. No.: 232,641

[22] Filed: Apr. 25, 1994

[51] Int. Cl.[6] ..... B65D 19/00

[52] U.S. Cl. ..... 108/51.1; 108/56.1; 52/664; 52/668; 52/233

[58] Field of Search ..... 108/51.1, 53.1, 108/53.3, 53.5, 56.1; 52/177, 483.1, 474, 664, 669, 668, 666, 233

[56] References Cited

U.S. PATENT DOCUMENTS

| | | | |
|---|---|---|---|
| 1,915,711 | 6/1933 | Adams | 52/233 |
| 2,129,497 | 9/1938 | Horn | 52/474 |
| 3,163,890 | 1/1965 | Pichon | 52/233 X |
| 4,115,969 | 9/1978 | Napier | 52/233 |
| 4,337,941 | 7/1982 | Kitka | 52/233 X |
| 4,841,880 | 6/1989 | Ferguson | 108/56.1 X |
| 4,869,179 | 9/1989 | Sammons et al. | 108/56.1 |
| 5,103,610 | 4/1992 | Walters | 52/233 |
| 5,115,609 | 5/1992 | Sing | 52/233 X |
| 5,237,936 | 8/1993 | Susel et al. | 108/51.1 X |
| 5,299,400 | 4/1994 | Sing | 52/233 X |

*Primary Examiner*—Kenneth J. Dorner
*Assistant Examiner*—Janet M. Wilkens
*Attorney, Agent, or Firm*—Nathaniel Altman

[57] ABSTRACT

Diametrically cut lengths of half- or quarter-logs positioned side-by-side with their cut flat surfaces forming a pallet platform, a floor, wall panelling or a fence are mounted on support rails held together by interlocking tongue-and-groove or dovetail joints and fastening elements where needed. Support rails are hollow converted log beams made from three-sided lengths of logs arranged to form a rectangular cross-sectional outline and held together by spacers at intervals. Provision is made to assure a level surface by adjusting depth of grooves to offset log taper. Pallets may be made to be readily disassembled for space-saving storage, shipping or repair, and four-way fork-lift access may be provided.

18 Claims, 2 Drawing Sheets

STRUCTURE FOR PALLETS, FLOORING, PANELLING AND FENCING

SPECIFICATION

1. Field of the Invention

This invention relates to wood structures for use as pallets, flooring, panelling and fencing, and to various improvements therein.

2. Background of the Invention

The potential for solving problems in two areas of technology simultaneously, with a single answer, has generated the interest and stimulated the development of the concepts of this invention. The continuing explosive growth of pallet use for lifting, storing and shipping has highlighted the negative characteristics of present-day pallets. These movable platforms tend to be expensive, heavy, subject to damage and difficult to repair or awkward to replace broken parts, and extremely space-wasting when stored or when empty in transit. At the same time, the lumber industry has found little or no effective profitable outlet for small diameter logs (in the range of three to six inch diameter, other than firewood, chips or pulp.

It is a primary object of this invention, therefore, to provide pallets made principally from small diameter logs which are strong, light, easy to repair or replace parts, space-saving by simple disassembly when not in use and easy reassembly, and above all, eminently inexpensive. It is another primary object of this invention to extend the elements and concepts used for pallets to provide advantageous improvements in the construction of flooring, panelling and fencing.

SUMMARY OF THE INVENTION

Small diameter logs are divided by longitudinal diametrical cuts into half-log or quarter-log lengths. A plurality of these lengths are arranged in parallel alignment, forming the platform or deck of a pallet, so that their arcuate surfaces are faced downwardly, and so that a flat level upper surface is provided by the array of log lengths. Each log length has grooves cut into its arcuate undersurface transversely at specified intervals to accommodate portions or projections of a plurality of transverse support rails on which the log lengths are fixedly mounted in tongue-and-groove or dovetail relationship. The grooves are cut into the log lengths to a specified depth so that the thickness of wood remaining between the deepest surface of each groove and the cut flat upper surface of each log length is a constant; by this means, any variation in thickness of the log lengths is bypassed and neutralized, thereby ensuring the level even surface of the log length assembly when mounted on uniform support rails. While this construction is primarily intended for pallets, its use in flooring, wood wall panelling and fencing has clear advantages and is recommended.

Various preferred embodiments, combinations, alternatives and substitutions will be described in full detail in connection with the accompanying illustrative but not limiting drawings, wherein:

SHORT FIGURE DESCRIPTION OF THE DRAWINGS

DESCRIPTION OF THE PREFERRED EMBODIMENTS

Figures 1, 2, 3, 4, 5, 6, 7, 8, 9, 10, 11, 12, 13:
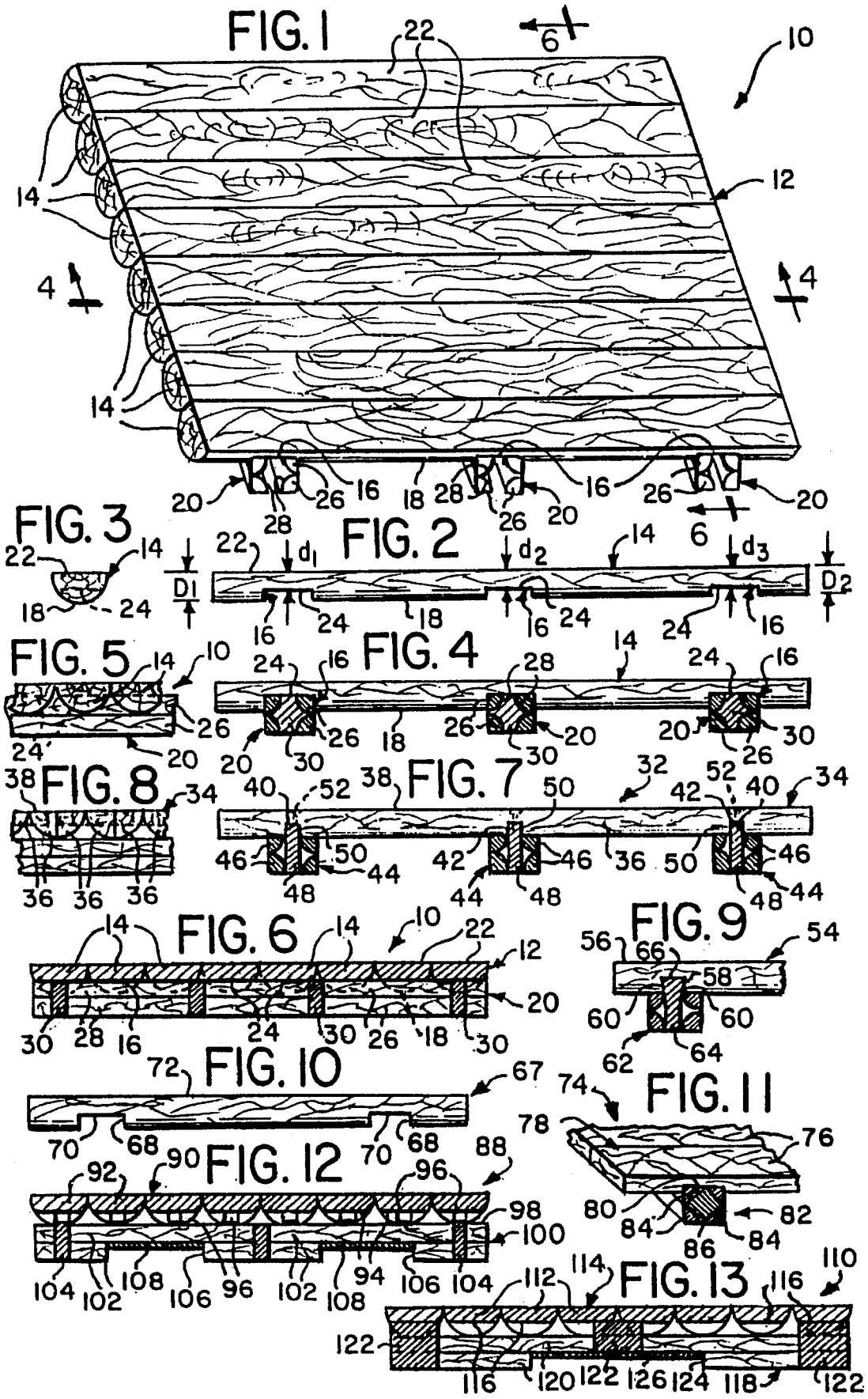
FIG. 1 is a perspective view of a pallet constructed in accordance with the concepts of this invention as seen from the top, front side and left end thereof.
FIG. 2 is a side elevational view of one of the half-logs used in the pallet deck of FIG. 1.
FIG. 3 is an end elevational view of the half-log of FIG. 1.
FIG. 4 is a longitudinal sectional view taken along line 4—4 of FIG. 1.
FIG. 5 is a fragmentary end elevational view of the pallet of FIG. 1.
FIG. 6 is a transverse sectional view taken along line 6—6 of FIG. 1.
FIG. 7 is a longitudinal sectional view similar to FIG. 4 of another pallet embodiment.
FIG. 8 is a fragmentary end elevational view of the pallet of FIG. 7.
FIG. 9 is a fragmentary sectional view of a modified pallet structure.
FIG. 10 is a side elevational view of a modified half-log for use in this invention.
FIG. 11 is a partial perspective view of another pallet embodiment.
FIGS. 12, 13 and 14 are transverse sectional views of more pallet embodiments.

FIG. 1 illustrates a pallet 10, its flat horizontal deck of platform 12 being constituted of parallelly disposed aligned half-log lengths 14. Each half-log length 14, cut longitudinally from small diameter logs, (in the range of three to six inch diameters) has a plurality of specifically spaced transverse rectangular grooves 16 cut into its lower arcuate surface 18 to accommodate the upper portions of support rails 20 set fittingly therein. For some purposes, pallet 10 may be used successfully with only the interlocking frictional grip of the walls of grooves 16 holding support rails 20 in place; it will be apparent that the connecting force keeping pallet 10 in assembled form may be fortified and enhanced by the use of conventional adhesives, nails, bolts, screws, dowels, pins, pegs and any combination thereof (not shown in this embodiment).

Typical half-log length 14 as shown in FIGS. 2 and 3 tapers down from larger diameter $D_1$ to smaller diameter $D_2$. To offset and neutralize the taper so that half-log lengths 14 present a level top surface 22 when mounted on matching support rails 20, all rectangular grooves are cut from below so that the distances $d_1$, $d_2$ and $d_3$ between top surface 22 of the half-log lengths 14 and the upper surface 24 of each groove 16 are identical in pallet 10 of FIG. 1. Thus, variations and unevenness in log lengths 14 are neutralized and bypassed, and flat level pallet deck 12 is ensured.

Support rails 20, best seen in FIGS. 4, 5 and 6, have been the subject matter of two U.S. Patents awarded to the present applicant: U.S. Pat. Nos. 5,115,609 and 5,299,400. Rails 20 are constructed each from four quarter-logs 26 so arranged that arcuate surfaces 28 thereof face inwardly and the cross-sectional outline of each rail 20 is rectangular. Spacers 30 are shaped and positioned to follow the interior arcuate contour of quarter-logs 26 at intervals along the length of each support rail 20 (see FIG. 6) to hold them together and to add strength and stability thereto, while retaining the lightness afforded by the remaining hollow space in these rail members.

A second pallet embodiment of the invention is displayed in FIGS. 7 and 8. Here, pallet 32 has horizontal deck 34 composed of quarter-logs 36 joined together in pairs in such a way that cut flat surfaces thereof form a level horizontal pallet deck surface 38, while the arcuate surfaces of each pair of quarter-logs 36 face inwardly toward each other and downwardly. All quarter-logs 36 have transverse rectangular grooves 40 cut so that upper groove surfaces 42 are parallel to and equidistant from top surface 38. Support rails 44 each comprise four quarter-logs 46 arranged in rectangular cross-sectional outline with rectangular spacers 48 fixed at intervals along the length of rails 44. In this embodiment, each spacer 48 has projecting extension 50 to be placed into and to engage fittingly a mating transverse groove 40 in each of a joined pair of quarter-logs 36. Screws 52 are shown for assuring the secure integrity of pallet 32.

It may be noted at this point that for economy, minimum space requirements and efficiency in handling, storing, shipping or repairing any of the pallet embodiments of this invention, the use of removable fastening means or reliance on tongue-and-groove or dovetail construction (see FIG. 11) makes these pallets readily disassemblable for storage or shipping without wasted space, and easily reassembled for further use.

The pallet assembly 54 of FIG. 9 is similar to that of FIGS. 7 and 8, but here each half-log 56 has transverse grooves or mortisise 58 with sloping sides 60, and support rails 62 have spacers 64 with their upwardly projecting extensions 66 serving as tenons, shaped complementary to and for mating with mortises 58 to form a secure dovetail joint.

The tapered half-log 67 of FIG. 10 differs from half-log 14 in FIG. 2 by having only two transverse grooves 68 cut near the ends thereof rather than three; as in half-logs 14, these grooves 68 have their upper surfaces 70 parallel to and equidistant from top flat surface 72 of half-log 67.

In FIG. 11, pallet 74 is illustrated as having conventional planks 76 forming its deck 78. Planks 76 are each provided with transverse grooves 80 dimensioned to accept fittingly support rails 82, which are composed of four equal right-triangle-shaped log parts 84 oriented to form a rectangular cross-section, with spacers 86 contacting and secured to the inner surfaces of log parts 84 at intervals along the length of support rails 82.

FIG. 12, similar to FIG. 6 in orientation, shows pallet 88 comprising pallet platform 90 assembled from half-log lengths 92, each length having transverse grooves 94 for accepting and surrounding vertically extending projections 96 fittingly therein. Projections 96 are fixedly mounted on top surface 98 of each transverse support rail 100, built from quarter-logs 102 held together and strengthened by rectangular spacers 104. Lower quarter-logs 102 have been cut out at two places 106 to provide fork-lift access at either end as well as at either side of pallet 88, thus permitting a four-way pallet-lifting capability. A strengthening and protective plate 108 has been mounted at the top of each cut-out opening 106 for wear and abrasion resistance.

Pallet 110 of FIG. 13, similar to pallet 88 of FIG. 12, has half-log lengths 112 forming platform or deck 114, each half-log length 112 having transverse grooves 116 cut into its lower surface with uniform distance remaining between the top of each groove 116 and the flat upper surface of deck 114. Each rectangular support rail 118 has quarter-logs 120 held in rectangular cross-section by spacers 122 which project upwardly into grooves 116 of half-log lengths 112. The lower quarter-logs 120 in each support rail 118 have a centrally disposed cut-out section 124 for fork-lift access, the upper surface of cut-out 124 being lined with protective plate 126.

Figures 14, 15, 16, 17, 18, 19, 20, 21, 22:
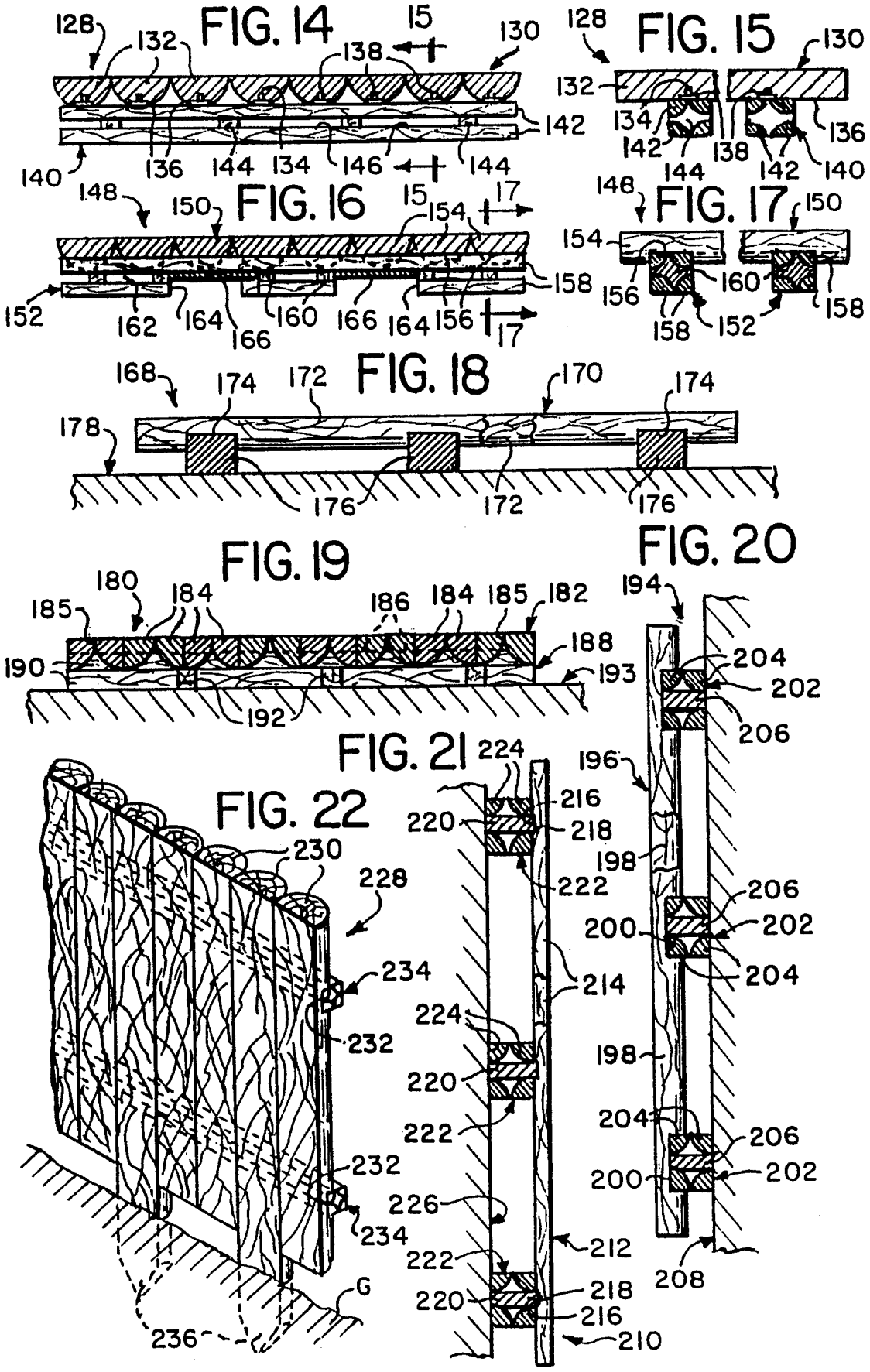
FIG. 15 is a sectional view taken along line 15—15 of FIG. 14.
FIG. 16 is a transverse sectional view of a modified version of the pallet of FIG. 14.
FIG. 17 is a sectional view taken along line 17—17 of FIG. 16.
FIG. 18 is a longitudinal sectional view similar to FIG. 4 taken through a flooring structure.
FIG. 19 is a transverse sectional view of another flooring embodiment.
FIG. 20 is a sectional view of a vertical wall with half-log panelling applied thereto.
FIG. 21 is a sectional view of a vertical wall with another embodiment of wall panelling applied thereto.
FIG. 22 is a perspective view of a fence constructed in accordance with the concepts of this invention.

All the support rails for pallets disclosed and described above are converted log beams which have been positioned so that their spacers and the hollow space remaining between these spacers are oriented vertically in their respective pallet assemblies. In contrast, in the pallet embodiments shown in FIGS. 14–17, all support rails, when compared to those described above, have been rotated 90 degrees about a longitudinal axis, so that spacers and spaces now face horizontally. In FIGS. 14 and 15, pallet 128 has its deck 130 composed of half-log lengths 132, each having spaced inverted T-shaped openings or grooves 134 drilled into its bottom surface 136. Each opening 134 fittingly accommodates a correspondingly shaped projection or connector 138 fixedly mounted on rectangular support rail 140, which is formed from equal-sized quarter-log sectors 142 held in place by horizontally disposed spacers 144 with horizontal hollow spaces 146 remaining therebetween. Hollow spaces 146 contribute to the lightness of pallet 128 and provide fork-lift access thereto.

Pallet 148 of FIGS. 16 and 17 places half-log length deck assembly 150 on horizontally oriented support rails 152. Half-log lengths 154 have transverse grooves 156, each to contain fittingly the upper portion of rectangular support rail 152, which comprises four equal quarter-logs 158 arranged in rectangular configuration, spacers 160 holding quarter-logs 158 with hollow spaces 162 there-between. Two cut-out sections 164 of lower quarter-logs 158, provided for fork-lift access, are top-lined with protective plates 166.

As indicated above, the concepts of this invention are of value for practical, effective and economical applications in fields other that pallets. Thus, FIG. 18 illustrates a simple practical flooring assembly 168, comprising a floor 170 made of half-log lengths 172, each having spaced transverse grooves 174 dimensioned to fit over conventional transverse beam 176 resting on flooring base 178.

Flooring assembly 180 of FIG. 19 is shown with floor 182 made from pairs of quarter-logs 184 joined together at trimmed edges 185 and having transverse grooves 186 for accommodating a converted log support rail 188 in each. Support rails 188 are constructed from four equal-sized quarter-logs 190, held in place by spacers 192 as in previous embodiments and mounted on flooring base 193.

Another use of the concepts of this invention is vertical wall panelling as illustrated in FIG. 20. Wall panelling assembly 194 comprises panelling 196 composed of half-log lengths 198, with grooves 200 for accommodating support rails 202. Rectangular support rails 202 hold panelling assembly 194 in place and are composed of quarter-logs 204 and spacers 206, identical in structure to those shown in FIG. 6. Support rails 202 may be fixedly mounted on base wall structure 208 by any conventional means.

Wall panelling assembly 210 is shown in FIG. 21, where panelling 212 is composed of conventional lumber lengths 214, each having transverse grooves 216 to mate with tongues 218 extending laterally from spacers 220. The construction of rectangular support rails 222, wherein spacers 220 hold quarter-logs 224 together is completely analogous to that of rails 34 in FIG. 7. It is apparent that support rails 222 may be mounted on base wall 226 by conventional methods, followed by the mounting of lumber lengths 214 on extending tongues 218, secured thereto by conventional fastening means.

Still another application of the concepts of this invention as fencing is shown in FIG. 22. Fencing structure 228 is composed of half-log lengths 230 having rectangular transverse grooves 232 cut into their arcuate surfaces, each groove 232 dimensioned to receive a portion of converted log connecting beam 234 in the assembled fence structure 228. Half-log lengths 230 may be used as fence posts by allowing them to extend downwardly and providing them with sharpened lower ends 236 for installation in ground G.

The preferred embodiments and the best modes of practicing this invention as now contemplated have been described fully. It will be apparent to anyone skilled in the art that various other embodiments, combinations, substitutions and modifications may be made without departing from the concepts of this invention, which are limited only by the scope of the ensuing claims, wherein:

What is claimed is:

1. Structure for pallets, flooring, panelling and fencing, which comprises:

a plurality of parallelly and adjacently aligned log lengths, each having a planar surface, said log lengths being so oriented that said planar surfaces together form an even level outer surface for the assembled structure, said log lengths being selected from the group consisting of: half-log sections cut longitudinally from small diameter logs, each cut flat surface thereof being part of said outer surface of the assembled structure; and quarter-log sections cut longitudinally, and diametrically twice, into right-angled sectors, said quarter-log sections being attached in pairs so oriented that one of the two cut flat surfaces of each of said attached pairs is in contiguous planar alignment with one of the two cut flat surfaces of its attached quarter-log mate, and is part of said outer surface of the assembled structure;

at least two support rails spacedly and transversely mounted and attached to said plurality of log lengths on the sides thereof opposite said cut assembled outer surfaces of the structure, said support rails being converted log beams each comprising:

four equally-sized elongate parts cut longitudinally from at least one log, said log parts having been cut each to have a three-sided cross-section, with two of said three sides being flat and meeting at a right angle, the third of said three sides being selected form the group consisting of: having an arcuate contour, each of said log parts thereby being a right-angled sector in cross-section, and having a flat contour, each of said log parts thereby being a right triangle in cross-section; and means for fixedly holding said four equal right-angled log parts together, said right-angled log parts being oriented when assembled so that said two of said three sides, form the right-angled outer corners of a generally rectangular cross-sectional outline for the assembled converted log product, said holding means comprising a plurality of spacers placed between and spacedly holding two pairs of said log parts, said spacers being laterally spaced from each other along the length of said four log parts, thereby creating hollow space in one direction between said two pairs of said four log parts;

means for interlocking each of said plurality of log lengths in said assembly with each of said at least two support rails; and means for neutralizing variations in thickness, irregularities and taper in each of said plurality of log lengths to ensure the levelness of the assembled structure.

2. Structure as defined in claim 1, wherein said small diameter logs may be selected from a range of between three and six inch diameters.

3. Structure as defined in claim 1, wherein said interlocking means comprises transverse grooves cut into the inner arcuate side of each of said plurality of log lengths opposite said planar surface thereof, each said groove being positioned and dimensioned to accept fittingly therein the upper portion of one of said at least two transverse support rails, so that when the structure is assembled, each of said support rails projects into, and is fittingly held within, one of said grooves in each of said plurality of log lengths in said assembly.

4. Structure as defined in claim 3, wherein each of said transverse grooves is dimensioned to accommodate a tongue-like extension of one of said plurality of spacers in one of said converted log support rails, so that when the structure is assembled, said tongue-like extensions fittingly engage and are set into said grooves in each of said plurality of log lengths in said assembly.

5. Structure as defined in claim 3, wherein said part of one of said transverse support rails comprises a projecting member mounted fixedly thereon and positioned to enter and to engage fittingly one of said grooves in said plurality of log lengths when the structure is assembled, said projecting member being made of a material selected from the group consisting of: metal, plastic and wood.

6. Structure as defined in claim 3, wherein each said transverse groove in said plurality of log lengths has tapered sides and each said part of one of said transverse support rails has a complementary reverse taper so that, when assembled, a dovetail joint is achieved.

7. Structure as defined by claim 3, wherein said means for ensuring said level flat assembled outer surface of the structure comprises a constant uniform distance, in all said transverse grooves, between said planar surface of each said log length and the deepest surface of each said groove, and said deepest surface of each said groove is parallel to said planar surface, whereby any variation in the thicknesses of said plurality of log lengths is neutralized and said level planar surface is assured.

8. Structure as defined in claim 1, further comprising fastening means for securing together said plurality of log lengths and said at least two support rails, said fastening means being selected from the group consisting of, adhesives, nails, bolts, screws, dowels, pins, pegs, and any combination thereof.

9. A pallet for storing, lifting and transporting objects, which comprises:

a plurality of parallelly and adjacently aligned log lengths arranged to form a horizontally disposed pallet platform assembly, said log lengths being selected from the group consisting of: half-log sections cut longitudinally from small diameter logs, said half-log sections being oriented so that the cut flat planar surfaces thereof form the upper surface of said pallet platform assembly; and quarter-log sections cut longitudinally and diametrically twice into right-angled sectors, said quarter-log sectors being attached in pairs so that one of the two cut flat surfaces of each of said attached pair of said quarter-log is in contiguous planar alignment with one of the two cut flat surfaces of its attached quarter-log mate as well as with one of the two cut flat surfaces of the other quarter-logs in pairs, all of which form said upper surface of said pallet platform assembly;

at least two support rails spacedly and transversely attached at the bottoms of said plurality of log lengths, said support rails being converted log beams, each said converted log beam comprising:

four equally-sized elongate parts cut longitudinally from at least one log, said log parts having been cut each to have a three-sided cross-section, with two of said three sides being flat and meeting at a right angle, the third of said three sides being selected from the group consisting of: having an arcuate contour, each of said log parts thereby being a right-angled sector in cross-section, and having a flat contour, each of said log parts thereby being a right triangle in cross-section; and means for fixedly holding said four equal right-angled log parts together, said right-angled log parts being oriented when assembled so that said two of three sides form the right-angled corners of a generally rectangular cross-sectional outline for the assembled converted log product, said holding means comprising a plurality of spacers placed between and spacedly holding two pairs of said log parts, said spacers being laterally spaced from each other along the length of said four log parts, thereby creating hollow space in one direction between said two pairs of said four log parts;

means for interlocking each of said plurality of log lengths in said assembly with each of said at least two support rails, said interlocking means comprising transverse grooves cut into said bottoms of said plurality of log lengths, each said groove being positioned and sized to accept fittingly therein part of one of said two support rails; and means for neutralizing variations in thickness, irregularities and taper in each of said plurality of log lengths to ensure the horizontal levelness of said pallet platform, said neutralizing means comprising a constant uniform distance, in all said interlocking grooves, between the top surface of said platform and the upper inner surface of each said groove, said upper surfaces of said grooves being parallel to said top surface of said pallet platform, whereby any variation in the thicknesses of said log lengths is overcome and said horizontally disposed level pallet platform results.

10. Pallet as defined in claim 9, further comprising fastening means for further securing together said plurality of log lengths and said at least two support rails, said fastening means being selected from the group consisting of: adhesives, nails, bolts, screws, dowels, pins, pegs and any combination thereof.

11. Pallet as defined in claim 9, further comprising fastening means for further securing together said plurality of log lengths and said at least two support rails, said fastening means being selectively removable, whereby the pallet may be disassembled easily for convenient space-saving shipping, storage, repair and part replacement thereof, and for rapid reassembly for further use, said plurality of log lengths and said at least two support rails each being substantially interchangeable.

12. Pallet as defined in claim 9, wherein each of said transverse grooves is dimensioned to accommodate the upper portion of one of said at least two support rails so that when the pallet is assembled, said support rails project, and are set fittingly, into one of said grooves in each of said plurality of log lengths in said pallet platform assembly.

13. Pallet as defined in claim 9, wherein each said transverse groove has tapered sides and each said part of said at least two support rails has a complementary reverse taper so that, when assembled, a dovetail joint is achieved.

14. Pallet as defined in claim 9, wherein said at least two support rails have said laterally spaced spacers as well as said hollow space therein being oriented vertically.

15. Pallet as defined in claim 14, further comprising at least one opening cut out of the lower said log part of each of said two pairs of said four log parts, said at least one opening being provided for fork-lift access in each of said at least two support rails so that the pallet may be fork-lifted from either side as well as from either end.

16. Pallet as defined in claim 15, further comprising a flat reinforcing plate mounted against the upper surface of said at least one fork-lift access opening to increase the strength, abrasion resistance and durability of the pallet.

17. Pallet as defined in claim 9, wherein said at least two support rails each have said laterally spaced spacers and said hollow space therein oriented horizontally and facing the pallet's sides, each said hollow space thereby being available for fork-lift access, thus giving the pallet lifting capability from four directions.

18. Structure for pallets, flooring, panelling, and fencing, which comprises:

a plurality of parallelly and adjacently aligned log lengths, each having a planar surface, said log lengths being so oriented that said planar surfaces together form an even level outer surface for the assembled structure, said log lengths being selected from the group consisting of: half-log sections cut longitudinally from small diameter logs, each cut flat surface thereof being part of said outer surface of the assembled structure; and quarter-log sections cut longitudinally, and diametrically twice, into right-angled sectors, said quarter-log sections being attached in pairs so oriented that one of the two cut flat surfaces of each of said attached pairs is in contiguous planar with one of the two cut flat surfaces of its attached quarter-log mate, both being part of said outer surface of the assembled structure;

at least two support rails spacedly and transversely attached to each of said plurality of log lengths on the sides thereof opposite said cut planar surfaces of the structure, said support rails being conventional lumber beams;

means for interlocking each of said plurality of log lengths in said assembly with each of said at least two support rails; and means for neutralizing variations in thickness, irregularities and taper in each of said plurality of log lengths to ensure the levelness of the assembled structure.

* * * * *